US006909353B2

(12) United States Patent
Romero Herrera et al.

(10) Patent No.: US 6,909,353 B2
(45) Date of Patent: Jun. 21, 2005

(54) MULTI-DIRECTIONAL CONTROL DEVICE

(75) Inventors: Ricardo Romero Herrera, deceased, late of Sant Climent de Llobregat (ES); by Nuria Lorenzo Riera, legal representative, Barcelona (ES)

(73) Assignee: Industrias Lorenzo, S.A., Barcelona (ES)

( * ) Notice: Subject to any disclaimer, the term of this patent is extended or adjusted under 35 U.S.C. 154(b) by 0 days.

(21) Appl. No.: 10/224,579

(22) Filed: Aug. 21, 2002

(65) Prior Publication Data

US 2003/0137394 A1 Jul. 24, 2003

(30) Foreign Application Priority Data

Aug. 21, 2001 (ES) ..... 200102127 U

(51) Int. Cl.[7] ..... H01C 10/14
(52) U.S. Cl. ..... 338/32 H; 338/128; 338/12
(58) Field of Search ..... 338/12, 32 H, 338/128, 135; 74/471 XY

(56) References Cited

U.S. PATENT DOCUMENTS 4,459,578 A * 7/1984 Sava et al. ..... 338/128
4,489,303 A * 12/1984 Martin ..... 338/128
4,733,214 A * 3/1988 Andresen ..... 338/128
4,825,157 A * 4/1989 Mikan ..... 324/207.2
5,861,796 A * 1/1999 Benshoff ..... 338/32 H

FOREIGN PATENT DOCUMENTS

ES 2098729 5/1997

* cited by examiner

*Primary Examiner*—Karl D. Easthom
(74) *Attorney, Agent, or Firm*—Jacobson Holman PLLC

(57) ABSTRACT

A multi-directional control device comprising a base (1) on which is mounted a stick (2) which is maintained in a non-active central position by elastic means (3) and which can be manually inclined to any orientation around said non-active central position against the force of said elastic means (3). Four hall effect sensors (4) are associated with said base (1) and one magnet (5) attached to said stick (2). The Hall effect sensors (4) are adapted to issue a signal in response to the variations in magnetic field produced by the movement of said magnet (5) when the stick (2) is inclined. The magnet (5) is in the form of a circular crown and is fastened to a non-accessible portion (2*b*) of the stick (2) with an upper face of the magnet (5) perpendicular to the stick (2), and the Hall effect sensors (4) are arranged around said stick (2) between the magnet (5) and an upper wall (22) of the base (1), in a plane which is substantially parallel to said upper magnet (5) face when the stick (2) is in said non-active central position and at a distance from the center of the same which is slightly less than the magnet (5) radius.

5 Claims, 2 Drawing Sheets

MULTI-DIRECTIONAL CONTROL DEVICE

The present utility model concerns a multi-directional control device, of the type popularly known as a "joystick", which includes a stick which is accessible to the user, together with some detectors that, in response to the inclination of this stick, will issue a direction signal corresponding to this same inclination.

The multi-directional control device of the present invention is useful for those industrial sectors where it is necessary to determine the position or displacement direction of visual components on a computer screen, such as video game machines, remote vehicle driving, whether viewed directly or by means of a video system, or control of motorised vehicle for handicapped persons, among others.

Multi-directional control devices or joysticks have been known for some time, and essentially comprises a base on which is mounted the stick which is held in a non-active central position by elastic means and at the same time this stick can be manually inclined in any direction around this central non-active position against the force of the elastic means. Associated with the base are sensor elements which issue a signal when selectively activated in response to the inclination of said stick.

Typically, the number of sensor elements is four, arranged at 90° intervals around the central stick position. These are used to produce signals corresponding to eight different orientations arranged at regular angular intervals of 45° which, using compass bearings, are N, E, S or W, when the stick inclination orientation coincides with and therefore activates each one of the four sensor elements individually, and NE, SE, SW and NW when the stick is inclined in the intermediate orientations, activating two contiguous sensor elements from which combined signals are obtained. It must be pointed out that in any of the possible stick inclination orientations, at least one and a maximum of two sensor elements may be activated.

Classic multi-directional control devices make use of micro-switches as sensor elements that are activated by the stick, with this activation being achieved through physical contact of a part of the stick, or of a part fixed to the stick, with the moving micro-switch actuating levers. This system has the inconvenience of micro-switch wear, which can be very serious in applications, such as video games where the very excitement of the game itself can lead to the user handling the joystick in a very rough manner.

There is, therefore, a requirement for sensor elements that can be operated by stick inclination, but without any physical contact between the two parts.

There is a control device or joystick design which employs optical sensors of the "emitter-receiver" type. In this joystick, a portion of the stick, when inclined, either interrupts or ceases to interrupt a light beam between the paired "emitter-receiver" elements of an optical sensor. Although in this construction activation is produced without any physical contact, the optical sensor arrangement is complex and requires certain environmental lighting conditions. Moreover, optical sensors are expensive and are very sensitive to dust and dirt in general.

Patent ES-A-2098729 discloses a joystick controller which uses Hall effect sensors to detect the differences in magnetic fields that are produced by the movement of a magnet located in an intermediate zone of the controller stick. In this device, the stick is made of elastic material and its lower end is firmly attached to the base, which in this case, takes the form of a cylindrical box housing the sensors and the magnet. However, this elastic stick arrangement is not very suitable for hard-use applications.

U.S. Pat. No. 4,489,303 describes a joystick that also makes use of the Hall effect. In this case, the stick is attached to the base by means of a block of elastomeric material so that a portion of the stick is accessible to the user and the other portion is located underneath the upper surface of the base. Four Hall effect sensors are arranged at regular intervals around the central axis of the stick when this is in the central non-active position, in a plane which is perpendicular to this axis and on a level that is slightly lower than that of a permanent magnet fixed to the lower end of the stick. When the stick is inclined in any direction, the magnet over-flies the Hall effect sensors and activates them. However, this arrangement of sensors underneath the lower end of the stick make the assembly very prominent at the lower section of the upper base surface, and in addition, the mounting using an elastomeric block is both relatively complex and expensive.

This utility model provides a joystick-type of multi-directional control fitted with a stick which activates sensors when inclined, but without any physical contact between the two elements and where the control device is both simple and economic.

In the multi-directional control device of the present invention, a stick is mounted on a base by means of a coaxial helicoidal spring fitted to the same stick that maintains it in a non-active central position which, at the same time, allows it to be manually inclined by a user in any direction around this non-active central position against the force of these described elastic means. This base defines a separation between a portion of the stick that is accessible to the user and another which is not accessible. A circular crown-shaped permanent magnet having an upper face perpendicular to the stick is fixed to the non-accessible portion of the stick. Several Hall effect sensors are associated with the base and arranged around said stick in a plane that is substantially perpendicular to this non-active central potion and facing the upper surface of the magnet at a distance from the center that is slightly less than the magnet radius. These Hall effect sensors are adapted to issue a signal is response to the variation in magnetic field produced by the magnet edge coming closer due to stick inclination.

With this arrangement a control device is achieved in which the mechanical elements are of simple, cheap construction, and where there is no physical contact between the control device and the sensors, which avoids wear and endows the device with long-life. This arrangement also permits to design a compact and protected assembly, with little protrusion of the non-accessible parts.

The invention may be better understood from the following detailed description of an exemplary embodiment, with reference to the attached drawings in which.

Figure 2:
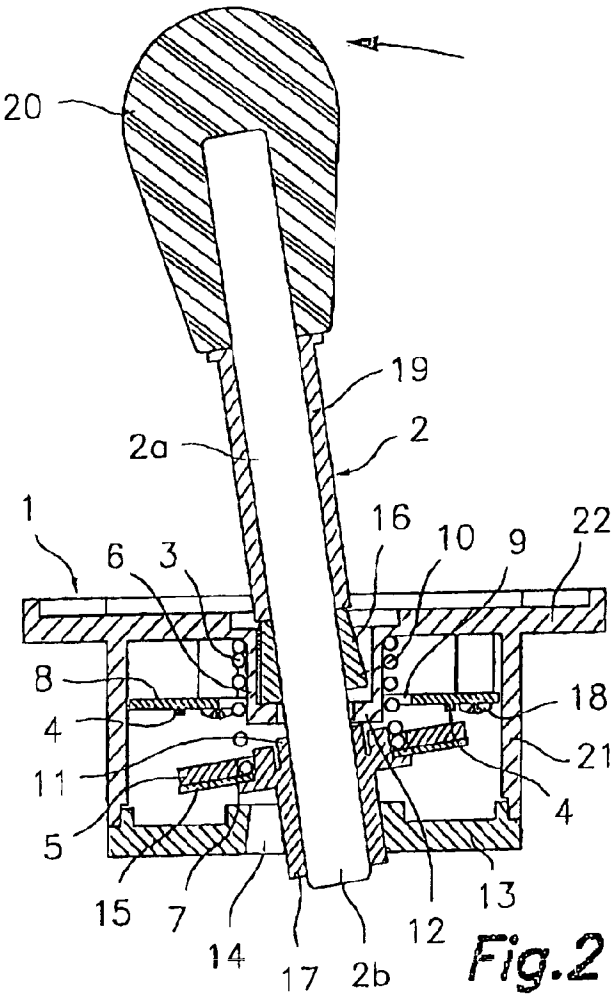
FIG. 2 is a cross-sectional view of the control device shown in FIG. 1, but in an inclined, active situation.
Figure 1:
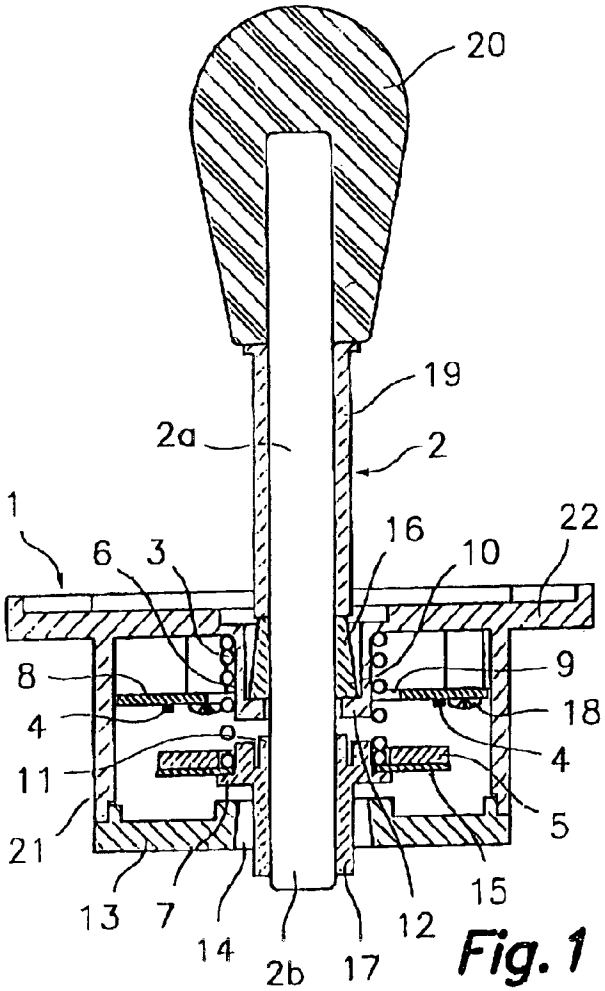
FIG. 1 is a cross-sectional view of the control device of the present utility model with the stick in the non-active central position.

First referring to FIGS. 1 and 2, the multi-direction control device of the present utility model comprises a base 1 on which a stick 2 is mounted, where this base 1 defines a separation between a portion 2*a* of the stick 2, which is accessible to the user and a second portion 2*b* of the stick 2 that is not accessible to the user. The stick 2 is mounted by means of a helicoidal spring 3 coaxially positioned around a tubular portion 6 of the base 1, through which the non-accessible portion 2*b* of the stick 2 passes. The helicoidal spring 3 is supported at one end by the base 1 and at the other end by a flange 7 which is firmly attached to a piece 17 that is fixed, for example, by means of an adhesive union to the non-accessible portion 2*b* of the stick 2. A first limit stop 10, fixed to the stick 2, is supported on an end rib 12 of the tubular portion 6 of the base 1 in order to retain the stick 2 against any axial slipping produced by the effect of the force caused by the helicoidal spring 3. Said first limit stop 10 is defined by one end of a piece 16 fixed to the stick 2, for example, by means of an adhesive union. Piece 16 has a conical wall to permit inclination of stick 2 in any direction, just as shown in FIG. 2.

Thus, in absence of any other outside force, spring 3 maintains the stick 2 in a non-active central position (FIG. 1) and at the same time permits the stick to be manually inclined by a user against the force of said spring 3 to any orientation (FIG. 2) around the non-active central position.

On the side corresponding to the non-accessible portion 2*b* of the stick 2, the base 1 defines a box that is delimited by side walls 21, and closed off by a cover 13 fitted with a circular aperture 14 through which the extreme far end of the non-accessible portion of the stick 2*b* of stick 2 projects. The circumferential edge of this circular aperture 14 acts as a limit stop for stick 2 inclination in any orientation, so that the lower edge of this aperture 14 is thickened and presents a conical configuration according to the envelope formed by all the inclined limit positions of stick 2, which defines a cone.

In the control device of this utility model, the entire sensor assembly is housed inside said box comprising the base 1 and substantially closed off by the cover 13. This sensor arrangement comprises a magnet 5 in the form of a circular crown, which is attached to said non-accessible portion 2*b* of the stick 2 so that an upper magnet face 5 is perpendicular to stick 2. Associated with the base 1 and around said stick 2 are arranged hall effect sensors 4 in a plane which is substantially parallel to this upper magnet 5 face when stick 2 is in the non-active central position. Sensors 4 are set at a distance from stick 2 center that is slightly less than the magnet 5 radius, so that they are superposed and facing said upper magnet 5 face in a protected position. These Hall effect sensors 4 are adapted to issue a signal is response to the variations in the magnetic field caused by the movement of this magnet 5 when the stick 2 is inclined. Note that the fact that the sensors 4 are arranged between the lower face of the upper wall 22 of the base 1 and the upper face of the magnet 5 allows for a compact assembly design and at the same time houses and protects the sensors 4.

The distance from the magnet 5 to the Hall effect sensors 4 is selected so that the magnetic field generated by the magnet 5 is insufficient to activate the Hall effect sensors 4 when the stick 2 is in the non-active central position as shown in FIG. 1. However, when the stick 2 is inclined in any orientation due to an exterior force, such as shown in FIG. 2, the peripheral edge of magnet 5 moves closer to one or two Hall effect sensors 4 so that the distance therebetween is reduced and the magnetic field intensity increased, which is then sufficient to activate the one or two sensors.

It is important that in any of the possible orientations of stick 2, at least one and at most two adjacent Hall effect sensors 4 are activated in order to produce the output signals corresponding to the orientations for each sensor when they are activated individually and the intermediate orientations when they are activated two at a time. The simultaneous activation of more than two sensors 4 would produce an error in the control logic system. Typically, the number of Hall effect sensors 4 is four, arranged at intervals of 90° around stick 2 and equidistant from it, although it is possible to have a different number. However, a very reduced number of sensors is of little practical interest and, on the other hand, the probability of more than two sensors being activated at the same time increases with the total number of sensors.

In the case where a user pulls the stick 2 upwards, this will undergo an axial movement in this same direction against the elastic force of spring 3 which will result in a reduction of the distance between magnet 5 and sensors 4. This movement is limited by a second limit stop 11 attached to the non-accessible portion 2*b* of stick 2, which is supported on the opposite side of said final rib 12 in order to retain stick 2 against this axial movement. Between these first and second limit stops 10,11, there is sufficient axial free play to permit stick 2 inclination, but which is insufficient for the Hall effect sensors 4 operation to be altered when the second limit stop 11 makes contact with the base 1. This occurs with the stick in the central non-active position, in which case the distance between the magnet 5 and the sensors 4, although it is the minimum possible, is insufficient to activate them, and when the stick 2 is inclined, in which case the distance, although is also the minimum possible, is sufficient to activate one or two sensors 4, but no more than two.

Preferably, the second limit stop 11 is an integral part of piece 17, which carries flange 7 on which spring 3 is supported and magnet 5 is joined to a washer 15 held against this described flange 7 by the pressure of helicoidal spring 3.

Figure 3:
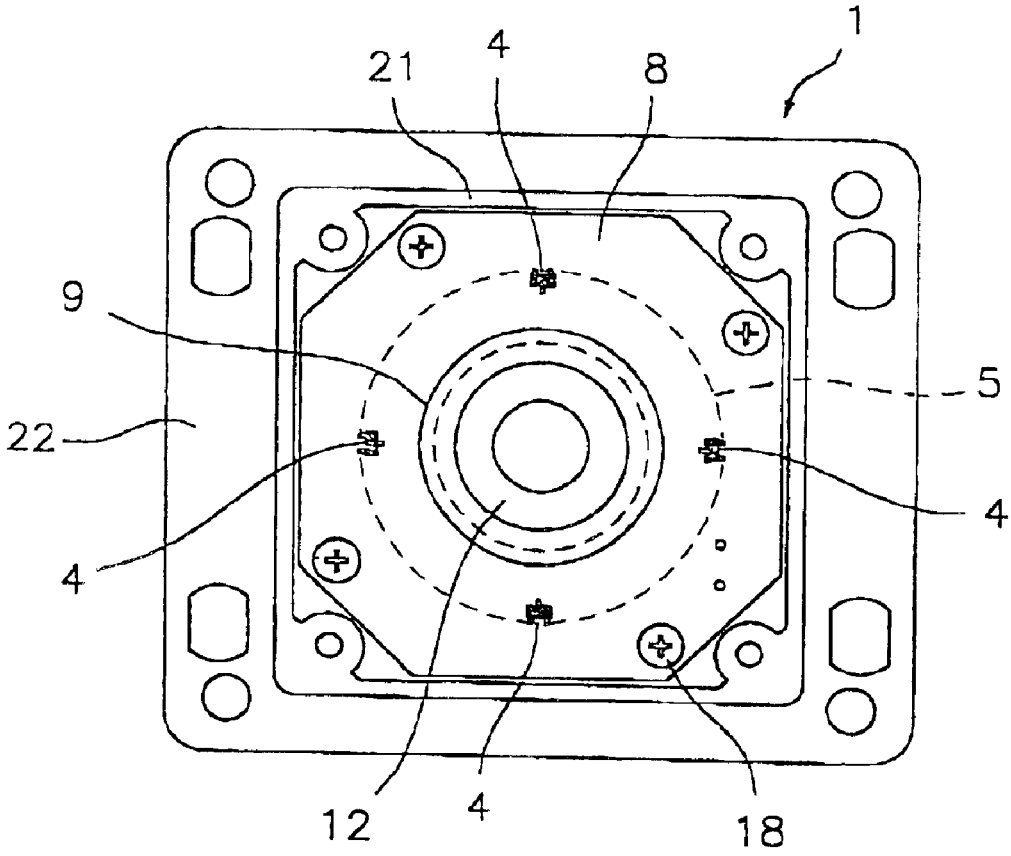
FIG. 3 is a lower plan view of the base of the control device shown in FIG. 1, in which the cover has been removed to reveal the sensor layout.

According to a preferred exemplary embodiment, the Hall effect sensors 4 are mounted on a printed circuit board 8 attached by means of screws 18 to base 1 on the side corresponding to the non-accessible portion 2*b* of stick 2, where the printed circuit board 8 comprises a central aperture through which said tubular portion 6 of the base 1 passes and the non-accessible portion 2*b* of stick 2. FIG. 3 shows a lower plan view of printed circuit board 8 configuration and the layout of the Hall effect sensors 4 on the same board. The dotted line circles in FIG. 3 indicate the limits of the circular crown magnet 5.

Preferably, the accessible portion 2*a* of stick 2 is covered by a trim or protector 19 and finished off with a handle 20.

One skilled in the art will be able to effect certain variations without leaving the scope of this invention, which is defined in the attached claims.

What is claimed is:

1. A multi-directional control device comprising:

a base on which is mounted a stick which is maintained in a non-active central position by elastic means and which can be manually inclined to any orientation around said non-active central position against the force of said elastic means, with Hall effect sensors being associated with said base and at least one magnet attached to said stick, where the Hall effect sensors are adapted to issue a signal in response to the variations in magnetic field produced by the movement of said magnet when the stick is inclined, where said base defines a separation between a portion of the stick that is accessible to the user and a portion which is not accessible to the user;

said magnet being in the form of a circular crown and being fastened to said non-accessible portion of the stick with an upper face of the magnet perpendicular to the stick, while the Hall effect sensors are arranged around said stick between the magnet and an upper wall of the base, in a plane which is substantially parallel to said upper magnet face when the stick is in said non-active central position and at a distance from the center of the same which is slightly less than the magnet radius, with the sensors superposed and facing said upper magnet face;

said magnet being at a distance from said Hall effect sensors which is insufficient to activate the Hall effect sensors when the stick is in the non-active central position but sufficient to cause said activation by virtue of the movement of the peripheral edge of the magnet towards one or two Hall effect sensors when the stick is inclined in any orientation, with at least one and at most two adjacent Hall effect sensors being activated in any of the possible combinations of stick inclination;

the elastic means comprising a helicoidal spring mounted coaxially around a tubular portion of the base through which the non-accessible portion of stick loosely passes, one end of said helicoidal spring being supported on base and the other end on a flange attached to a piece attached to the non-accessible portion of stick, a first limit stop in the form of a thickening fixed to the stick being provided to abut on a final rib of the tubular portion of the base in order to retain the stick against axial movement due to the force produced by the helicoidal spring; and the Hall effect sensors being mounted on a printed circuit board attached to the base, the printed circuit board comprising a central aperture through which the non-accessible portion of stick is passed.

2. The control device, in accordance with claim 1, characterised in that a second limit stop is attached to the stick to abut on the opposite side of said final rib in order to retain the stick against any axial movement in the opposite direction due to an outside force against the helicoidal spring force, an axial play being provided between said first and second limit stops sufficient to permit the stick inclination but insufficient to alter Hall effect sensors operation when the second limit stop comes into contact with the base, which is, when the distance between the magnet and the Hall effect sensors is the minimum possible.

3. The control device, in accordance with claim 1, characterised in that the Hall effect sensors are mounted on the printed circuit board attached to base on the side corresponding to the non-accessible portion of stick, where said tubular portion of the base passes through the central aperture of the print circuit board.

4. The control device, in accordance with claim 1, characterised in that the magnet is a permanent magnet which is attached to a washer held against said flange by the pressure of the helicoidal spring.

5. The control device, in accordance with claim 3, characterised in that the base defines a box on the side corresponding to the non-accessible portion of the stick housing the printed circuit board carrying the Hall effect sensors and the magnet, said box being closed off by a cover with a circular aperture through which one end of the non-accessible portion of the stick projects, with the circumferential edge of said circular aperture forming a limit stop for the stick inclination in any direction.

* * * * *